US007667476B2

(12) United States Patent
Zogmal et al.

(10) Patent No.: US 7,667,476 B2
(45) Date of Patent: Feb. 23, 2010

(54) MEASURING MODULE FOR RAPID MEASUREMENT OF ELECTRICAL, ELECTRONIC AND MECHANICAL COMPONENTS AT CRYOGENIC TEMPERATURES AND MEASURING DEVICE HAVING SUCH A MODULE

(75) Inventors: Olivier Zogmal, Zurich (CH); Daniel Guy Baumann, Zurich (CH); Frank Lehnert, Rueti (CH)

(73) Assignee: Bruker Biospin AG, Faellanden (CH)

( * ) Notice: Subject to any disclaimer, the term of this patent is extended or adjusted under 35 U.S.C. 154(b) by 0 days.

(21) Appl. No.: 12/292,970

(22) Filed: Dec. 2, 2008

(65) Prior Publication Data

US 2009/0146676 A1 Jun. 11, 2009

(30) Foreign Application Priority Data

Dec. 5, 2007 (DE) ..... 10 2007 055 712

(51) Int. Cl.
*G01R 31/02* (2006.01)
*F25D 23/12* (2006.01)

(52) U.S. Cl. ..... 324/760; 324/158.1; 62/259.2

(58) Field of Classification Search ..... 324/760; 62/259.2; 165/80.1–80.5
See application file for complete search history.

(56) References Cited

U.S. PATENT DOCUMENTS

| | | | | |
|---|---|---|---|---|
| 4,115,736 | A | 9/1978 | Tracy | |
| 5,704,220 | A * | 1/1998 | Yamazaki | 62/259.2 |
| 5,889,456 | A | 3/1999 | Triebe et al. | |
| 6,184,504 | B1 * | 2/2001 | Cardella | 219/513 |
| 6,191,599 | B1 * | 2/2001 | Stevens | 324/760 |
| 2002/0014894 | A1 * | 2/2002 | Yonezawa et al. | 324/760 |
| 2004/0046584 | A1 * | 3/2004 | Ollila et al. | 324/760 |
| 2007/0057686 | A1 * | 3/2007 | Suga et al. | 324/760 |

OTHER PUBLICATIONS

By H. Nyquist "Thermal Agitation of Electric Charge in Conductors", Physical Review, vol. 32, Jul. 1928, pp. 110-113.

(Continued)

*Primary Examiner*—Ha Tran T Nguyen
*Assistant Examiner*—Emily Y Chan
(74) *Attorney, Agent, or Firm*—Paul Vincent

(57) ABSTRACT

Measuring module for the measurement of an object (6), having a measuring chamber (4), with a contact element (5*a*, 5*b*), wherein the object to be measured (6) is thermally connected to a first contact surface (9*a*) of the contact element (5*a*, 5*b*), and having a cold head (1*b*, 2*b*, 2*c*) that can be thermally connected to a second contact surface (9*b*) of the contact element (5*a*, 5*b*), wherein the contact element (5*a*, 5*b*) consists of material with high thermal conductivity, characterized in that the cryo-refrigerator (1*a*, 2*a*) together with the cold head is housed in a refrigerating chamber (3) that is physically separated from the measuring chamber (4) and can be evacuated separately from the latter, and the contact element (5*a*, 5*b*) is thermally insulated from the outside wall of the measuring module, is part of a separating wall between the measuring chamber (4) and the refrigerating chamber (3), and makes a local thermal connection between the measuring chamber (4) and the refrigerating chamber (3), and with a contacting mechanism to vary heat flow in the hermetically sealed condition of the measuring module. With such a measuring module, cooling times and heating times of the object to be measured can be greatly reduced.

9 Claims, 5 Drawing Sheets

OTHER PUBLICATIONS

By J.B. Johnson, "Thermal Agitation of Electricity in Conductors", Physical Review, vol. 32, Jul. 1928, pp. 97-109.

Internet Website "lakeshore.com/desertcryo/custom/index.html", Horizontal + Vertical Probe Systems. Nov. 2007 (8 pages).

* cited by examiner

MEASURING MODULE FOR RAPID MEASUREMENT OF ELECTRICAL, ELECTRONIC AND MECHANICAL COMPONENTS AT CRYOGENIC TEMPERATURES AND MEASURING DEVICE HAVING SUCH A MODULE

This application claims Paris Convention priority of DE 10 2007 055 712.6 filed Dec. 5, 2007 the complete disclosure of which is hereby incorporated by reference.

BACKGROUND OF THE INVENTION

The invention relates to a measuring module for the measurement and testing of an object, having a measuring chamber that can be evacuated that is to hold the object to be measured and having a contact element, wherein the object to be measured is thermally connected to a first contact surface of the contact element during the measurement and/or test operation, and having at least one cold head that can be thermally connected to a second contact surface of the contact element, wherein the cold head can be cooled down to cryogenic temperatures using a cryo-refrigerator comprising at least one cold stage, and wherein the contact element consists of material with high thermal conductivity, and the first and second contact surfaces are located on opposite sides of the contact element, wherein the cold head and the contact element are thermally conductively interconnected during the measurement and/or testing operation in an environment that can be evacuated.

Such a measurement device is known from [2].

The thermal noise of electronic components can be reduced by cooling. The thermal noise arises due to statistical movements of the charge carriers and due to irregular, temperature-dependent grid oscillations that are transferred to the charge carriers by pulses. It manifests itself as a noise voltage $V_R$ at the ends of electrical conductors. At an ohmic resistance R that is at temperature T, the noise voltage in the frequency range Δf is calculated as [3], [4]:

$$|V_R| = \sqrt{4kRT - \Delta f} \text{ where } k = 1.38 \cdot 10^{-23}\ Ws/K \text{ (=Boltzmann constant)}$$

Reducing the temperature T of metal conductors also reduces their resistance R so that the product R·T and therefore the thermal noise voltage $V_R$ is especially greatly reduced. For this reason, this cooling method is used today for sensitive measuring instruments and sensors, such as are found, for example, in NMR spectroscopy [1]. A clear improvement in measurement sensitivity is achieved in such cases, i.e. the signal-to-noise ratio (=SINO).

For the development of such measuring instruments or sensors with cooled electrical or electronic components, suitable electronic or electrical components (e.g. cables, resistors, transistors, etc.) must be assessed in advance and undergo quality control testing (e.g. thermal cycling). For this purpose, test systems are required that enable the cooling of individual electronic components and whole electronic circuits down to their operating and test temperature with the aim of determining their properties and specifications and to conduct quality control tests on them.

The simplest and most widespread method of cooling to cryogenic temperatures is to use liquid nitrogen (LN2) or in rarer cases, liquid helium (LHe). The components to be measured (electronic components or circuits, mechanical components, or combinations thereof) are immersed in a Dewar vessel filled with LN2 or LHe. Quality control tests (e.g. thermal cycling tests) and/or determination of electrical and mechanical properties of components can be performed in this way.

The disadvantages of this method are that the lowest cryogenic temperature is dependent on the boiling temperature of the liquid gas 77K for LN2 and 4.2K for LHe), and the test samples are exposed to extreme thermal stress due to the high cooling rates. Moreover, water condensation and ice can form on the samples.

In a somewhat more advanced cooling method, the object to be cooled measured is attached to a contact element with high thermal conductivity that is cooled down to the desired temperature by a refrigerant (e.g. LN2 or LHe). To keep thermal losses low, the entire configuration is housed in an evacuated chamber, which avoids the formation of condensation and ice [2]. However, such systems are only efficient at temperatures just above the boiling point of the refrigerant. If test samples have to be tested far above the boiling point (but still far below room temperature), this must be performed by additional heating of the contact element, which in turn results in increased loss of refrigerant and increased costs (especially if the refrigerant is LHe). A further disadvantage in this case is that the user is always reliant on the refrigerant and must ensure that a sufficient stock of it is available. Such a set-up also has the disadvantage that the user must be versed in the handling of cryogenic liquids.

In addition to this, measuring modules are known in which the cooling is not performed by a cryogenic refrigerant but a cryo-refrigerator with a closed refrigerating circuit [2]. The disadvantage of this measuring module is that the cryo-refrigerator first has to be switched off, followed by a long waiting time before the cryo-refrigerator has warmed up sufficiently for the chamber in which the test sample is located to be opened.

Based on this prior art, the object of the invention is to propose a measuring module and a measuring device with which such long waiting times can be avoided to make cooling the objects to be measured more convenient.

SUMMARY OF THE INVENTION

This object is inventively solved by housing the cryo-refrigerator together with the cold head in a refrigerating chamber that is physically separated from the measuring chamber and can be evacuated separately, by attaching the contact element such that it is thermally insulated from the outside wall of the measuring module, is part of a separating wall between the measuring chamber and the refrigerating chamber, and makes a local thermal connection between the measuring chamber and the refrigerating chamber, and by providing a contacting mechanism to vary the heat flow in the hermetically sealed condition of the measuring module by means of which the heat flow between the cold head and the contact element can be either established, greatly increased, interrupted, or greatly reduced.

With the inventive measuring module, it is possible to implement a cooling process without cryogenic fluids, wherein the test temperature of the objects being measured can be selected within the defined temperature range due to the variably settable heat flow between the cold head and the contact element.

The cryo-refrigerator can remain cold during cooling or heating of the object being measured. The cooling rates for the object being measured can therefore be shortened compared with prior art by approximately the cooling time specified by the cryo-refrigerator manufacturer, since the cryo-refrigerator does not have to be cooled again. The typical cooling time of a cryo-refrigerator is between 40 and 60 minutes. Unnecessary thermal stress on the cryo-refrigerator is also avoided.

The separate chambers for the object being measured and the cryo-refrigerator also permit optimum thermal insulation between the measuring chamber and the cooling head.

The cooling rate $\Delta T_K/\Delta t$ and the heating rate $\Delta T_W/\Delta t$ can be freely set with the inventive measuring module and can be chosen to avoid damaging the object being measured.

Moreover, the desired cooling cycles are performed automatically, and their number can be freely selected.

The inventive measuring module is easy to operate and permits simple mounting and replacement of the objects to be measured.

The inventive contacting mechanism preferably comprises a pneumatic, hydraulic, or electrical drive, or a combination thereof, or a manual drive with which the cold head and the contact element can be mechanically moved toward each other or away from each other, wherein the cold head and the contact element are either pressed against each other or physically separated, so that the heat flow between them is increased or reduced. The drive permits both contacting of the object to be measured with the cooling head via the two contact surfaces of the contact element and separation of the same contact quickly and simply.

Alternatively, the contacting mechanism can comprise a connecting element that is located between the cold head and the contact element and is permanently in close thermal contact with the cold head and the contact element, wherein the connecting element has at least one hollow space that can be filled with a fluid with high thermal conductivity at cryogenic temperatures, wherein the thermal conductivity of the connecting element and therefore the heat flow between the cold head and the contact element can be varied. This also shortens cooling and heating times, making it possible to dispense with moving mechanical components, which results in a very simple design.

The contact element preferably comprises a heat exchanger that is operated with a cryogenic fluid, in particular, liquid nitrogen or liquid helium and is used to pre-cool the contact element. The essential advantage of this embodiment is a high cooling rate for objects to be measured that have a high heat capacity so that the cooling time can be further shortened.

In an especially preferred embodiment of the inventive measuring module, at least one temperature sensor and at least one heater are provided that are used to regulate the temperature of the contact element. Further temperature sensors can also be attached to the object to be measured so that their temperature can be measured and regulated directly.

It is moreover advantageous when the cryo-refrigerator has two stages, each with one cold head, wherein the cold head of the first stage is thermally connected to a heat exchanger that is used to liquefy nitrogen gas. This embodiment has the advantage that the cryogenic fluid required for pre-cooling is generated autonomously, i.e. no longer has to be procured externally.

The invention also relates to a measuring device with an inventive measuring module described above wherein the contact element is attached such that it is thermally insulated from the external environment of the measuring module. For example, the contact element can be attached at the end of the bellows-shaped dividing wall between the measuring chamber and refrigerating chamber, thus thermally insulating it from the outside wall of the measuring module.

The advantage is a measuring device that comprises a measuring module with a connection element that is disposed between the cold head and the contact element and is in permanent, close thermal connection with the cold head and the contact element, wherein the connecting element has at least one hollow space and wherein devices for feeding and pumping away a fluid with high thermal conductivity at cryogenic temperatures to and from the hollow space of the connecting element are provided, wherein the heat flow between the cold head and the contact element can be increased or reduced.

A measuring device is especially advantageous that comprises a measuring module in which the cryo-refrigerator has two stages each with a cold head wherein the cold head of the first stage is thermally connected to a heat exchanger for the liquefaction of nitrogen gas, and wherein the first stage of the cryo-refrigerator is connected to a nitrogen separator via the heat exchanger, through which the nitrogen gas can be obtained directly from the air and fed to the heat exchanger.

Further advantages of the invention can be derived from the description and the drawing. The characteristics stated above and below can be used individually or any number of them may be used in any combination. The embodiments shown and described are not intended as an exhaustive list but are examples used to describe the invention.

DESCRIPTION OF THE PREFERRED EMBODIMENT

Figure 5A:
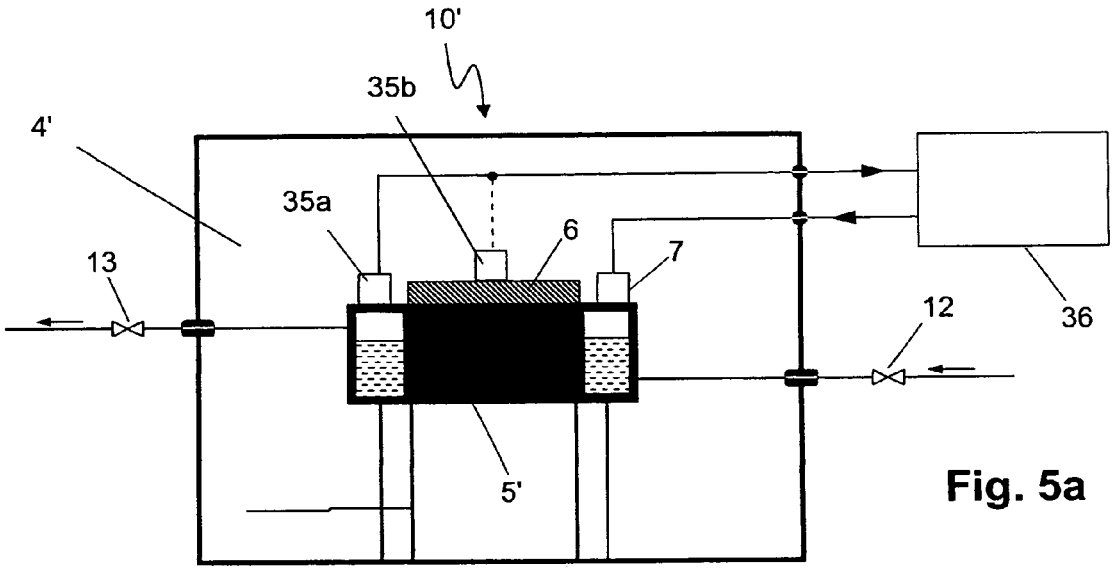
Fig. 5a PRIOR ART
FIG. 5*a* a measuring module according to the prior art wherein cooling of the contact element is performed using a cryogenic fluid and FIG. 5*b* a measuring module according to the prior art wherein cooling of the contact element is performed using a cryo-refrigerator.

FIG. 5*a* shows a measuring device according to prior art. A measuring module 10' is for cooling, measurement, and testing of an object to be measured 6. The object to be measured 6 is attached to a contact element 5' with high thermal conductivity that is cooled down to the required temperature using a refrigerant (e.g. LN2 or LHe). To keep the thermal losses small, the entire set-up is housed in an evacuated chamber 4', which also avoids the formation of water condensation and ice. The required measuring temperature can be regulated, for example, using a controller 36, a heater 7 and temperature sensors 35*a*, 35*b*. To boost efficiency and minimize the loss of refrigerant, the feeding of the refrigerant can also be controlled via valves 12, 13.

Figure 5B:
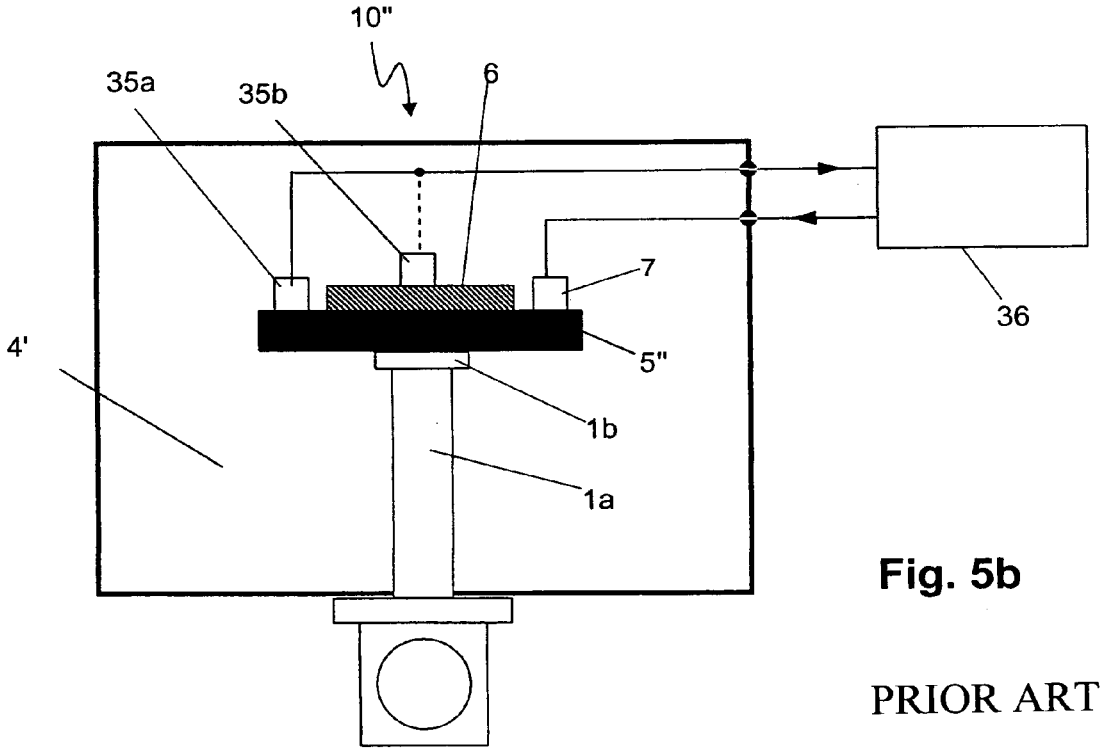
Fig. 5b PRIOR ART

FIG. 5*b* shows a further measuring device known according to the prior art that differs from that in FIG. 5*a* in that the refrigeration is not performed using a cryogenic refrigerant but using a cryo-refrigerator 1*a* with a closed refrigerating circuit. A measuring module 10" comprises a cold head 1*b* and a contact element 5". The cold head 1*b* can be cooled down to cryogenic temperatures using a cryo-refrigerator 1*a* comprising at least one cold stage. The contact element 5" consists of material with high thermal conductivity and is positioned between the object to be measured 6 and the cold head 1*b*. These components are located in an evacuated environment during the measurement and/or test process and are thermally conductively interconnected.

The cold head 1*b*, which is cooled by the first cooling stage of the cryo-refrigerator 1*a* with a certain cooling power, is permanently connected to a contact element 5" that ideally takes on the temperature of the cold head 1*b* without thermal stress. The object to be measured 6 can then be mounted on the contact element 5". The temperature of the contact element 5" and the object to be measured 6 can be regulated with the controller 36, heater 7, and temperature sensors 35*a*, 35*b*.

Figure 1A:
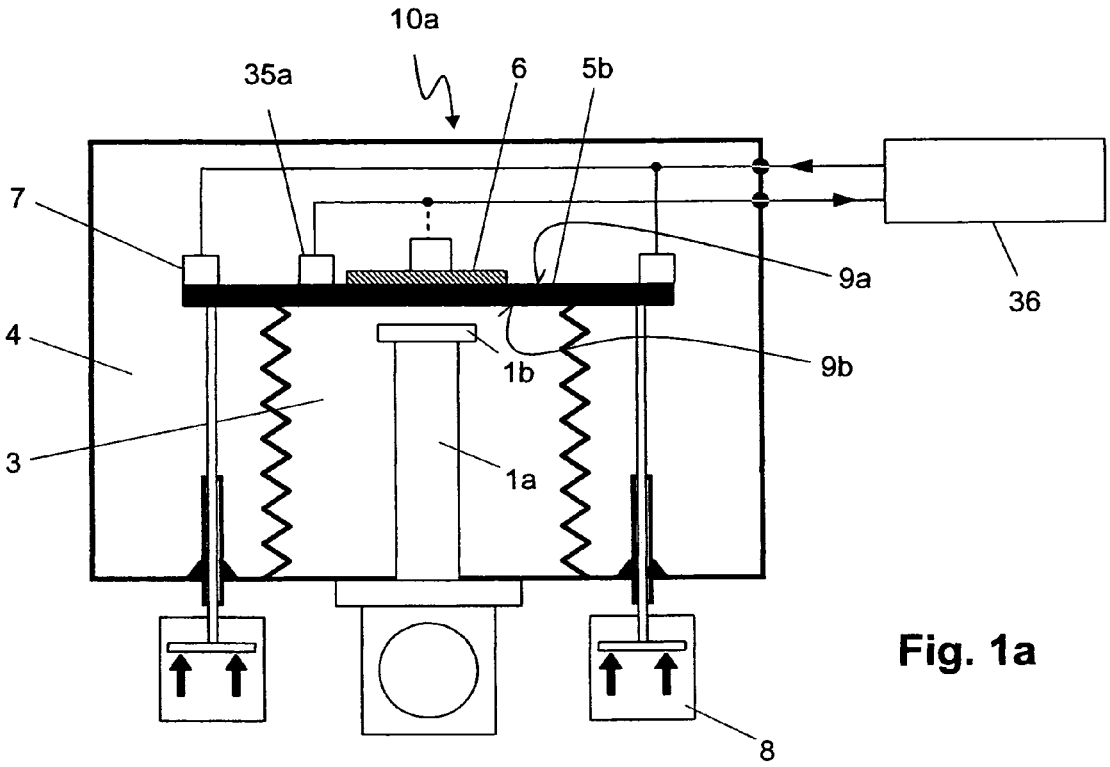
FIG. 1*a* an inventive measuring module with a one-stage cryo-refrigerator in the non-contacted condition.
Figure 1B:
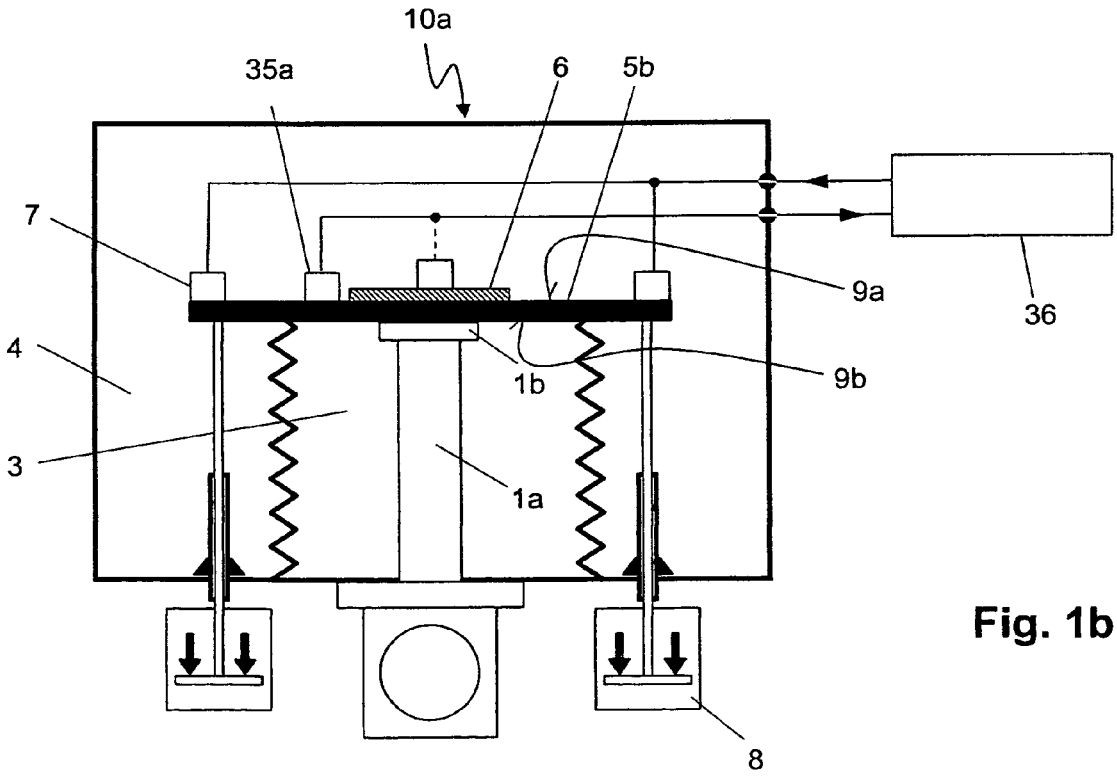
FIG. 1*b* an inventive measuring module with a one-stage cryo-refrigerator in the contacted condition.

FIGS. 1*a*, 1*b* show a first embodiment 10*a* of an inventive measuring module. Unlike the known devices, the inventive measuring module 10*a* comprises a two-chamber system with a refrigerating chamber 3 and a measuring chamber 4 that can be evacuated separately. Refrigerating chamber 3 contains the cryo-refrigerator 1*a* with a cold head 1*b* and a closed refrigerating circuit. A Stirling, a Gifford, a McMahon, or a pulse tube refrigerating device can be used as the cryo-refrigerator 1*a*. The refrigerating chamber 3 is evacuated and insulated during measuring operation, thus thermally insulating the cryo-refrigerator 1*a* from its environment.

The object to be measured 6 is located in the measuring chamber 4, which is also evacuated, and is permanently connected with a contact element 5*b* on its first contact surface 9*a*. The contact element 5*b* is constituted as part of the dividing wall between the two chambers 3, 4 and is used as the local thermal connection from the refrigerating chamber 3 to the measuring chamber 4. The contact element 5*b* is attached to a point that is thermally insulated with respect to the outer wall of the measuring module.

The heat flow between the cold head 1*b* and the contact element 5*b* is varied by mechanically moving the cold head 1*b* and the contact element 5*b* toward each other or away from each other by means of a pneumatic, hydraulic, or electric drive 8, a combination thereof, or by a manual drive, which either presses the cold head 1*b* and the contact element 5*b* against each other (FIG. 1*b*) or physically separates them (FIG. 1*a*), so that the heat flow between them is increased or reduced. In the first case, the cold head 1*b* contacts the contact element 5*b* at a second contact surface 9*b* and the contact element 5*b* is cooled down to the desired temperature together with the object to be measured 6 by the cryo-refrigerator. In the second case, the contact between the cold head 1*b* and the second contact surface 9*b* of the contact element 5*b* is separated so that the contact element 5*b* together with the object to be measured 6 is warmed up again without having to first switch off the cryo-refrigerator 1*a*.

The controller 36 with a connected heater 7 and temperature sensor 35*a* permits regulation of the temperature of the contact element 5*b* and therefore of the object to be measured 6 to the desired value. To heat up, drive 8 moves the contact element 5*b* away from the cold head 1*b* and interrupts the heat flow between them (FIG. 1*b*). The heater 7 then permits quick heating of the contact element 5*b* and the object to be measured 6. The cryo-refrigerator 1*a* continues to run and the cold head 1*b* cools down to the lowest possible temperature because it is no longer thermally loaded. In this embodiment, the user is not dependent on cryogenic liquids.

Figure 2A:
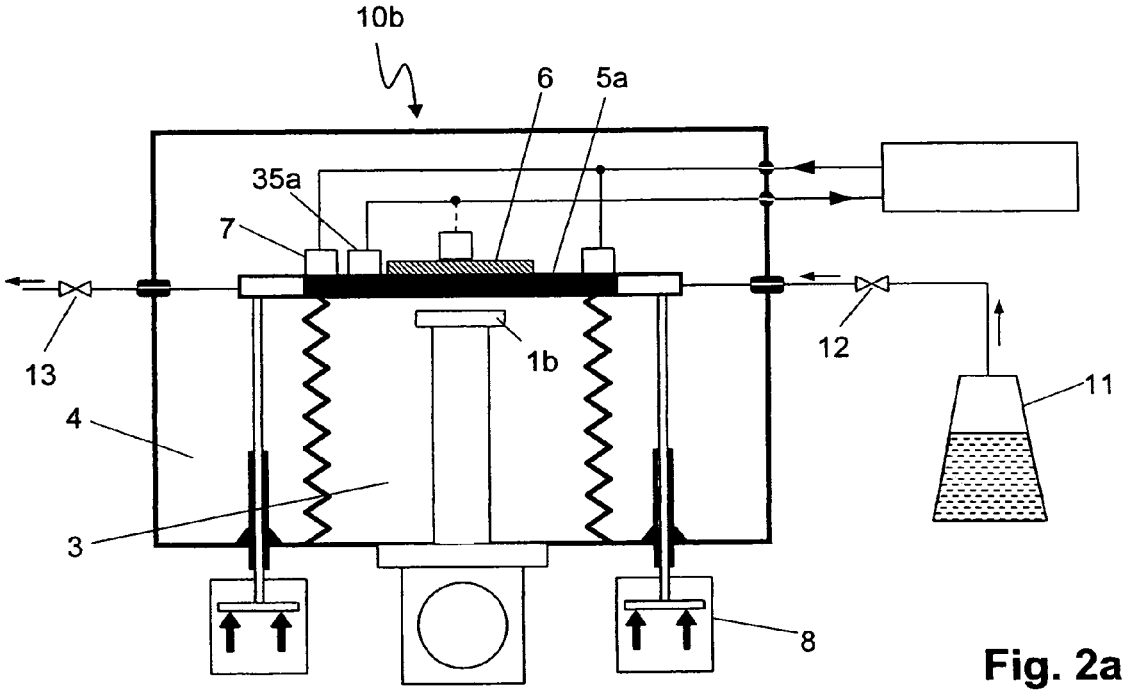
FIG. 2*a* an inventive measuring module with a one-stage cryo-refrigerator and a heat exchanger in the non-contacted condition.
Figure 2B:
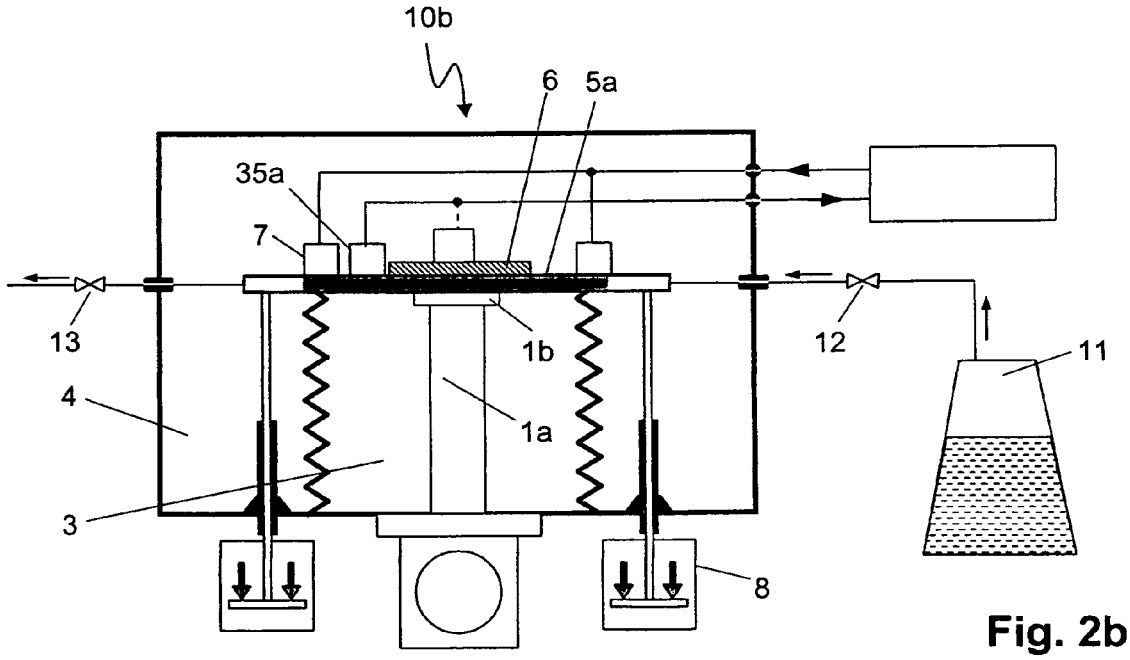
FIG. 2*b* an inventive measuring module with a one-stage cryo-refrigerator and a heat exchanger in the contacted condition.

An improved embodiment 10*b* of the inventive measuring module is shown in FIG. 2*a* and FIG. 2*b*. It results in a very large reduction in cooling times and differs from the previous embodiment in that a contact element 5*a* is provided with a heat exchanger through which a cryogenic fluid (LN2 or LHe) flows, permitting pre-cooling of the contact element 5*a* and of the object to be measured 6. The inlet valve 12 and the outlet valve 13 control the flow of the refrigerant. During the cooling process, the valves 12 and 13 are open and the cryogenic fluid in a Dewar vessel 11 is pressed through insulated tubes into the heat exchanger of the contact element 5*a*, for example, by generating excess pressure in the Dewar vessel 11, which cools down contact element 5*a*. The times for cooling down to the boiling point of the cryogenic fluid are highly reduced compared with cooling using the cryo-refrigerator alone (e.g. a Gifford-McMahon cryo-refrigerator).

As soon as the contact element 5*a* has reached the temperature of the cryogenic fluid, the valves 12 and 13 are closed again. The drive 8 then moves the contact element 5*a* down and thermally connects it with the cold head 1*b* (see FIG. 2*b*). The temperature of the contact element 5*a* is measured with the temperature sensor 35*a* and can be regulated with the heater 7.

For heating, the contact element 5*a* is moved upward by means of the drive 8 which interrupts its thermal contact with the cold head 1*b* (see FIG. 2*a*). The heater 7 then permits accelerated heating of the contact element 5*a* and therefore also of the object to be measured 6. In this cooling method, it is however important to ensure that the Dewar vessel 11 always contains enough cryogenic fluid.

Figure 3A:
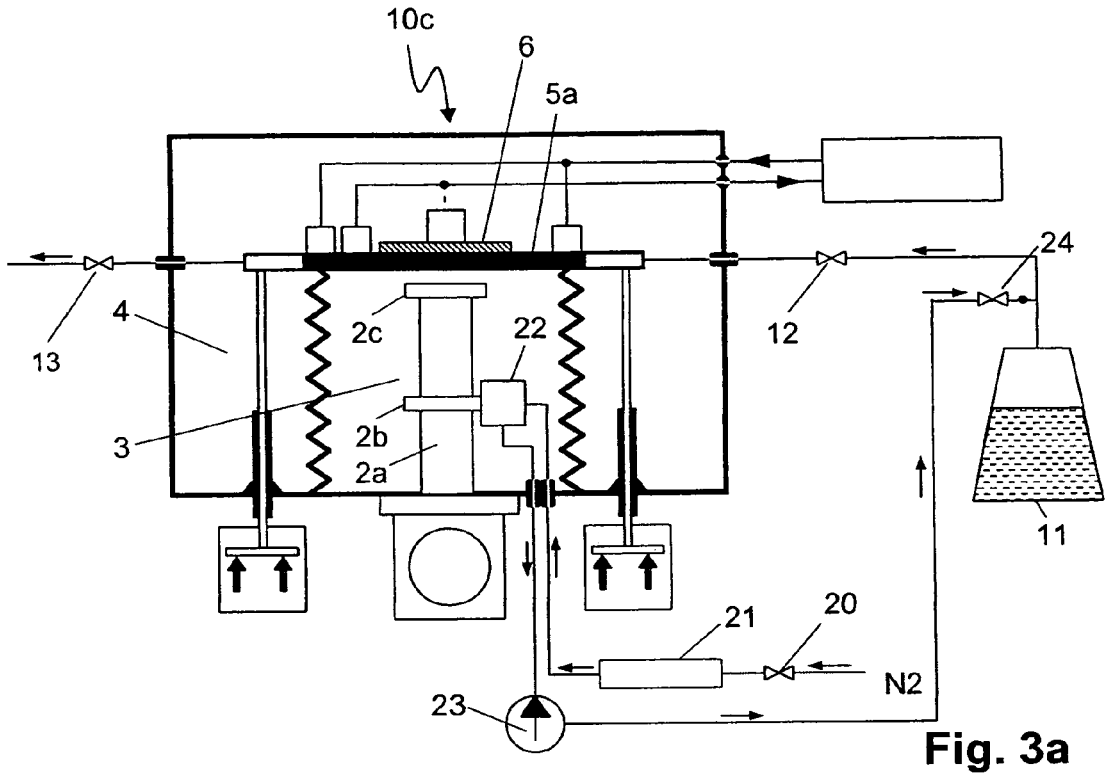
FIG. 3*a* an inventive measuring module with a two-stage cryo-refrigerator and a heat exchanger in the non-contacted condition.
Figure 3B:
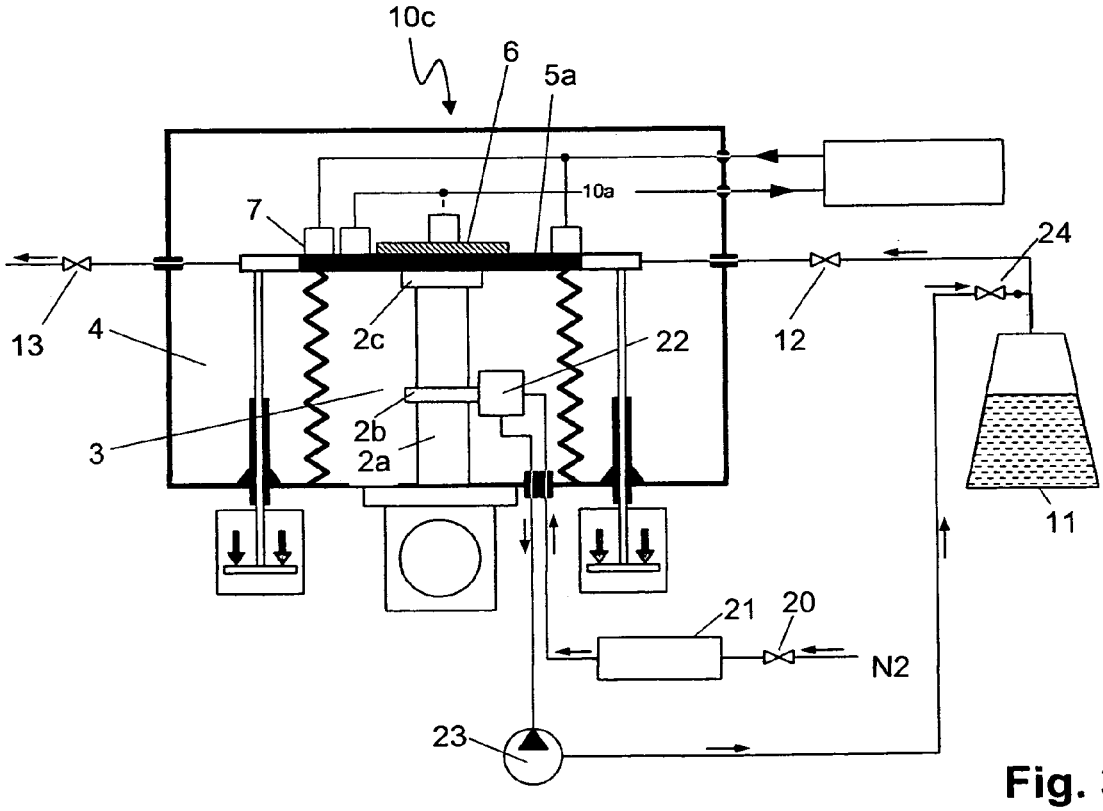
FIG. 3*b* an inventive measuring module with a two-stage cryo-refrigerator and a heat exchanger in the contacted condition.

A further embodiment 10*c* of the inventive measuring module is illustrated in FIG. 3*a* and FIG. 3*b*. This embodiment differs from that in FIG. 2*a* and FIG. 2*b* in that a two-stage cryo-refrigerator 2*a* is used and that the first stage of this cryo-refrigerator 2*a* is used to liquefy N2 gas to pre-cool the contact element 5*a* that is already shown in the variant of FIG. 3*a* and FIG. 3*b*. An inlet valve 20 controls the supply of air to a nitrogen separator 21. The nitrogen already in the air is first separated from the other gases using the nitrogen separator 21 before it is fed to a heat exchanger 22, where it is liquefied. The heat exchanger 22 is thermally connected to a cold head 2*b* of the first stage of the cryo-refrigerator 2*a* which cools it down to the required temperature. Using a pump 23, the liquefied nitrogen is then fed through an outlet valve 24, which is used to control the nitrogen liquefied in the heat exchanger 22, and delivered into the Dewar vessel 11. The valves 20, 24 permit switch-on and switch-off of the nitrogen liquefaction. If the valves 12, 13 are opened or closed to pre-cool the contact element 5*a*, the valves 20, 24 are closed or opened. A cold head 2*c* of the second stage of the cryo-refrigerator 2*a* contacts the contact element 5*a* in an analogous way to the cold head 1*b* in FIG. 2*a*, 2*b*.

Figure 4:
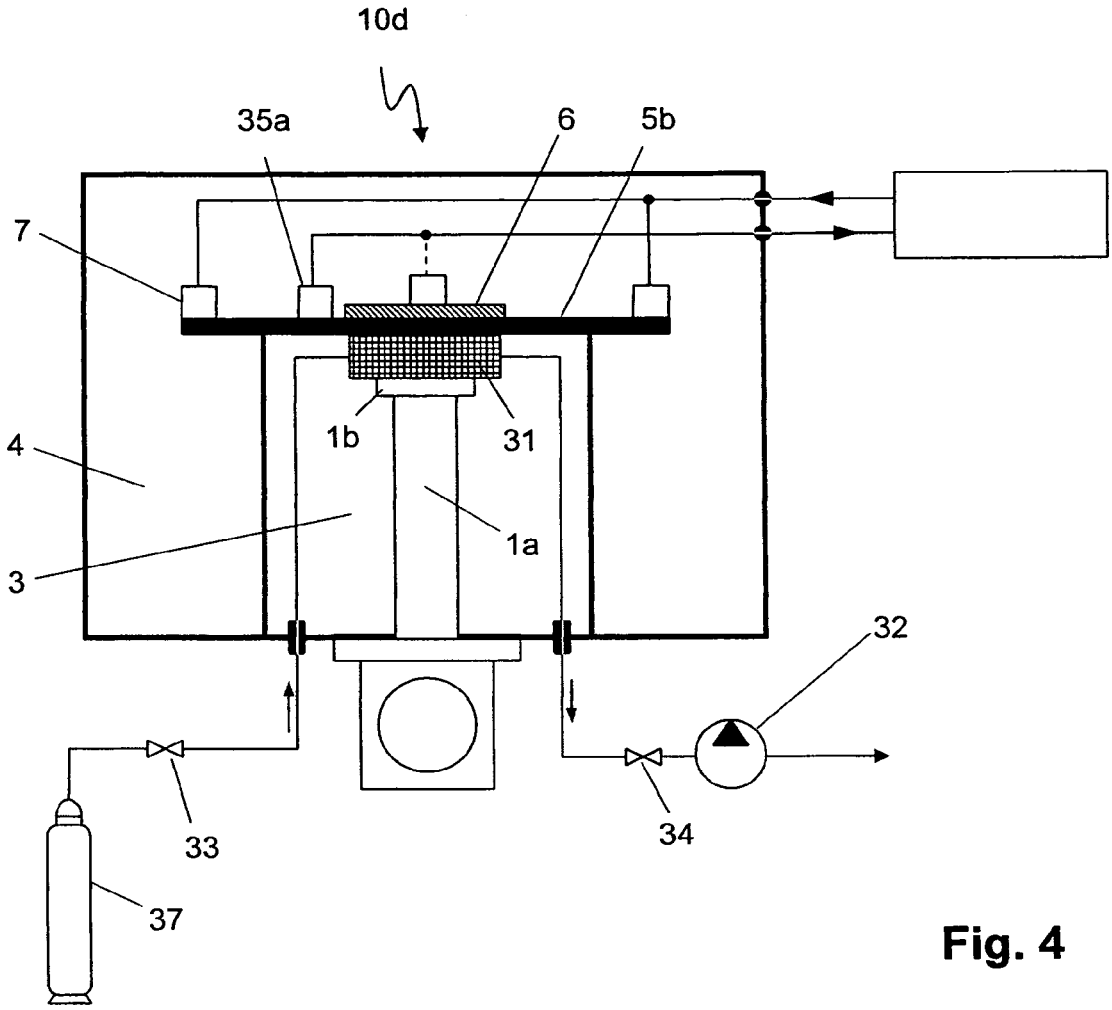
FIG. 4 an inventive measuring module with a one-stage cryo-refrigerator and a connecting element with variable thermal conductivity.

FIG. 4 shows a further variant of the inventive measuring module in which no moving mechanical parts are required inside the vacuum region. The heat flow between the cold head 1*b* and the contact element 5*b* is varied by installing a connecting element 31 between the two elements, that is permanently in close thermal contact with the cold head 1*b* and the contact element 5*b*. The connecting element 31 has at least one hollow space into which a gas with high thermal conductivity at cryogenic temperatures is pressed or from which it is pumped out to increase or reduce the heat flow between the cold head and the contact element.

If the gas with high thermal conductivity at cryogenic temperatures (e.g. He) is fed into the connecting element 31 or out of it, the thermal conductivity of the connecting element 31 is increased or reduced respectively. In this way, pressing in the gas increases the heat flow between the contact element 5*b* and the cold head 1*b* so that the contact element 5*b* is cooled along with the object to be measured 6.

The connecting element 31 is connected via an inlet valve 33 to a gas pressure canister 37 and via an outlet valve 34 to a vacuum pump 32. To cool the object to be measured 6, the inlet valve 33 is opened, the outlet valve 34 is closed, and the connecting element 31 is filled with gas via the gas pressure canister 37. This substantially increases the thermal conductivity of the connecting element and, as a consequence, the contact element 5*b* and the object to be measured 6 are cooled. When the object to be measured 6 has reached the desired temperature, its temperature is regulated with the sensor 35*a* and the heater 7.

To heat up the object to be measured 6, the inlet valve 33 is closed and the outlet valve 34 is opened. After that, the connecting element 31 is pumped empty with the vacuum pump 32 which again reduces the thermal conductivity of the connecting element 31 and the contact element 5*b* can again be heated up using the heater 7.

By the inventive separation of the measuring chamber 4 and refrigerating chamber 3, optimum insulation of the measuring chamber 4 from the cold head 1*b*, 2*c* is achieved as soon as the cold head 1*b*, 2*c* is moved away from the contact element 5*a*, 5*b*. The inventive measuring module 10*a*, 10*b*, 10*c* with the inventive two-chamber system has the advantage that the cryo-refrigerator 1*a*, 2*a* remains cold during cooling or heating of the object to be measured 6. This shortens the cooling rates for the object to be measured 6 because the cryo-refrigerator 1*a*, 2*a* does not have to be re-cooled, and unnecessary thermal stress on the cryo-refrigerator 1*a*, 2*a* is also avoided. The inventive measuring module and therefore also the inventive measuring device has a high level of flexibility because the contact element 5*a*, 5*b* can be easily adapted or replaced depending on the application.

REFERENCE LIST

[1] Patent EP 0 878 718 A1: NMR-Messvorrichtung mit gekühltem Messkopf

[2] http://www.lakeshore.com/desertcryo/custom/index.html

[3] J. B. Johnson, Thermal agitation of electricity in conductors, Phys. Rev., vol. 32, pp. 97-109, 1928

[4] H. Nyquist, Thermal agitation of electricity in conductors, Phys. Rev., vol. 32, pp. 110-113, 1928

LIST OF REFERENCES

1*a* Single-stage cryo-refrigerator
1*b* Cold head of the one-stage cryo-refrigerator
2*a* Two-stage cryo-refrigerator
2*b* Cold head of the first stage of the two-stage cryo-refrigerator
2*c* Cold head of the second stage of the two-stage cryo-refrigerator
3 Refrigerating chamber
4 Measuring chamber
4' Chamber (prior art)
5*a* Contact element with heat exchanger
5*b* Contact element
5' Contact element (prior art)
5" Contact element (prior art)
6 Object to be measured
7 Heater
8 Drive
9*a* First contact surface of the contact element
9*b* Second contact surface of the contact element
10*a* Measuring module
10*b* Measuring module
10*c* Measuring module
10*d* Measuring module
10' Measuring module (prior art)
10" Measuring module (prior art)
11 Dewar vessel
12 Inlet valve for pre-cooling
13 Outlet valve for pre-cooling
20 Inlet valve for nitrogen liquefaction
21 Nitrogen separator
22 Heat exchanger for nitrogen liquefaction
23 Pump
24 Outlet valve for liquid nitrogen
31 Connecting element
32 Vacuum pump
33 Inlet valve
34 Outlet valve
35*a* Temperature sensor
36 Controller
37 Gas pressure canister

The invention claimed is:

1. A measuring module for measuring and testing an object, the module comprising:

a measuring chamber, said measuring chamber structured for holding the object to be measured within an evacuated environment;

a refrigerating chamber, said refrigerating chamber being physically separated from said measuring chamber and structured for evacuation independently of said measuring chamber;

a contact element having a first contact surface and a second contact surface, the object to be measured being thermally connected to said first contact surface during measurement and/or test operation, wherein said contact element consists essentially of a material having high thermal conductivity, said first and second contact surfaces being located on opposite sides of said contact element, wherein said contact element constitutes part of a separating wall between said measuring chamber and said refrigerating chamber, said contact element facilitating local thermal connection between said measuring chamber and said refrigerating chamber;

at least one cold head disposed within said refrigerating chamber, said at least one cold head disposed, structured, and dimensioned for thermal connection to said second contact surface of said contact element, wherein said cold head and said contact element are thermally conductively connected during the measurement and/or testing operation with said refrigerating chamber evacuated;

a cryo-refrigerator having at least one cold stage, said cryo-refrigerator disposed within said refrigerating chamber for cooling said cold head down to cryogenic temperatures;

means for thermally insulating said contact element from an outside wall of the measuring module; and a contacting mechanism, said contacting mechanism structured and dimensioned to establish, greatly increase, interrupt, and greatly reduce heat flow between said cold head and said contact element in a hermetically sealed condition of the measuring module.

2. The measuring module of claim 1, wherein said contact element comprises a heat exchanger that is operated with a cryogenic fluid liquid nitrogen, or liquid helium to pre-cool said contact element.

3. The measuring module of claim 1, further comprising at least one temperature sensor and at least one heater disposed and structured to regulate a temperature of said contact element.

4. The measuring module of claim 1, wherein said cryo-refrigerator has two stages, each with a cold head, wherein a cold head of a first stage is thermally connected to a heat exchanger that is structured to liquefy nitrogen gas.

5. A measuring module for measuring and testing an object, the module comprising:

a measuring chamber, said measuring chamber structured for holding the object to be measured within an evacuated environment;

a refrigerating chamber, said refrigerating chamber being physically separated from said measuring chamber and structured for evacuation independently of said measuring chamber;

a contact element having a first contact surface and a second contact surface, the object to be measured being thermally connected to said first contact surface during measurement and/or test operation, wherein said contact element consists essentially of a material having high thermal conductivity, said first and second contact surfaces being located on opposite sides of said contact element, wherein said contact element constitutes part of a separating wall between said measuring chamber and said refrigerating chamber, said contact element facilitating local thermal connection between said measuring chamber and said refrigerating chamber;

at least one cold head disposed within said refrigerating chamber, said at least one cold head disposed, structured, and dimensioned for thermal connection to said second contact surface of said contact element, wherein said cold head and said contact element are thermally conductively connected during the measurement and/or testing operation with said refrigerating chamber evacuated;

a cryo-refrigerator having at least one cold stage, said cryo-refrigerator disposed within said refrigerating chamber for cooling said cold head down to cryogenic temperatures;

means for thermally insulating said contact element from an outside wall of the measuring module; and a contacting mechanism, said contacting mechanism structured and dimensioned to establish, greatly increase, interrupt, and greatly reduce heat flow between said cold head and said contact element in a hermetically sealed condition of the measuring module, wherein said contacting mechanism comprises at least one of a pneumatic, hydraulic, electrical, and manual drive with which said cold head and said contact element can be mechanically moved toward and away from each other, wherein said cold head and said contact element are either pressed against each other or physically separated, so that said heat flow between them is increased or reduced.

6. A measuring module for measuring and testing an object, the module comprising:

a measuring chamber, said measuring chamber structured for holding the object to be measured within an evacuated environment;

a refrigerating chamber, said refrigerating chamber being physically separated from said measuring chamber and structured for evacuation independently of said measuring chamber;

a contact element having a first contact surface and a second contact surface, the object to be measured being thermally connected to said first contact surface during measurement and/or test operation, wherein said contact element consists essentially of a material having high thermal conductivity, said first and second contact surfaces being located on opposite sides of said contact element, wherein said contact element constitutes part of a separating wall between said measuring chamber and said refrigerating chamber, said contact element facilitating local thermal connection between said measuring chamber and said refrigerating chamber;

at least one cold head disposed within said refrigerating chamber, said at least one cold head disposed, structured, and dimensioned for thermal connection to said second contact surface of said contact element, wherein said cold head and said contact element are thermally conductively connected during the measurement and/or testing operation with said refrigerating chamber evacuated;

a cryo-refrigerator having at least one cold stage, said cryo-refrigerator disposed within said refrigerating chamber for cooling said cold head down to cryogenic temperatures;

means for thermally insulating said contact element from an outside wall of the measuring module; and a contacting mechanism, said contacting mechanism structured and dimensioned to establish, greatly increase, interrupt, and greatly reduce heat flow between said cold head and said contact element in a hermetically sealed condition of the measuring module, wherein said contacting mechanism comprises a connecting element that is located between said cold head and said contact element and is permanently in close thermal contact with said cold head and said contact element, wherein said connecting element has at least one hollow space that can be filled with a fluid having high thermal conductivity at cryogenic temperatures, to thereby vary a thermal conductivity of said connecting element and therefore said heat flow between said cold head and said contact element.

7. The measuring module of claim 6, further comprising means for supplying and pumping away a fluid with high thermal conductivity at cryogenic temperatures into or out of said hollow space of said connecting element, wherein said heat flow between said cold head and said contact element can be increased or reduced.

8. The measuring module of claim 6, wherein said cryo-refrigerator has two stages, each with a cold head, wherein a cold head of a first stage is thermally connected to a heat exchanger that is structured to liquefy nitrogen gas.

9. The measuring module of claim 8, wherein said first stage of said cryo-refrigerator is connected to a nitrogen separator via said heat exchanger, through which nitrogen gas can be obtained directly from air and fed to said heat exchanger.

* * * * *